US009878846B2

(12) United States Patent
Strom

(10) Patent No.: US 9,878,846 B2
(45) Date of Patent: Jan. 30, 2018

(54) COMMERCIAL WASTE CONTAINER SYSTEMS AND METHODS

(71) Applicant: Roy Andrew Strom, Glen Ellyn, IL (US)

(72) Inventor: Roy Andrew Strom, Glen Ellyn, IL (US)

( * ) Notice: Subject to any disclaimer, the term of this patent is extended or adjusted under 35 U.S.C. 154(b) by 52 days.

(21) Appl. No.: 14/257,365

(22) Filed: Apr. 21, 2014

(65) Prior Publication Data

US 2014/0314530 A1 Oct. 23, 2014

Related U.S. Application Data

(60) Provisional application No. 61/814,196, filed on Apr. 19, 2013.

(51) Int. Cl.

| | |
|---|---|
| ***B65F 1/00*** | (2006.01) |
| ***B65F 1/12*** | (2006.01) |
| ***B65F 3/02*** | (2006.01) |
| ***B65F 3/00*** | (2006.01) |

(52) U.S. Cl.

CPC ..... *B65F 3/001* (2013.01); *B65F 1/004* (2013.01); *B65F 1/122* (2013.01); *B65F 3/02* (2013.01)

(58) Field of Classification Search

CPC ..... B65F 1/0033; B65F 1/004; B65F 1/12; B65F 1/122; B65F 3/001; B65F 3/02

USPC ..... 414/406

See application file for complete search history.

(56) References Cited

U.S. PATENT DOCUMENTS

| | | | | |
|---|---|---|---|---|
| 5,098,250 A * | 3/1992 | Carson | B65F 1/004 | 220/909 |
| 5,257,877 A * | 11/1993 | Zelinka | B65F 3/046 | 414/406 |
| 5,901,874 A * | 5/1999 | Deters | B65F 1/02 | 220/694 |
| 6,102,283 A * | 8/2000 | Kann | B65F 1/004 | 193/32 |
| 6,224,317 B1 * | 5/2001 | Kann | B65F 3/041 | 414/406 |
| 6,357,988 B1 * | 3/2002 | Bayne | B65F 1/004 | 220/555 |
| 2012/0043327 A1 * | 2/2012 | Baltz | | |
| 2012/0055834 A1 * | 3/2012 | Hay | B65F 1/02 | 206/505 |

* cited by examiner

*Primary Examiner* — Anna Momper
*Assistant Examiner* — Ashley Romano
(74) *Attorney, Agent, or Firm* — Richards Patent Law P.C.

(57) ABSTRACT

The present disclosure includes a commercial waste system including a commercial waste container and a commercial waste vehicle. The waste container includes an interior volume that may be divided by a container divider into at least two container chambers, to collect waste and/or other multiple types of recoverable (recyclable) materials without comingling. Additionally, the rear loading waste vehicle includes a hopper divider and a storage divider, such that collection of the multiple types of waste from the divided container does not comingle the collected materials.

10 Claims, 10 Drawing Sheets

10

COMMERCIAL WASTE CONTAINER SYSTEMS AND METHODS

CROSS-REFERENCE TO RELATED APPLICATIONS

This application incorporates by reference and claims priority to U.S. Provisional Application No. 61/814,196 filed on Apr. 19, 2013.

BACKGROUND OF THE INVENTION

The present subject matter relates generally to commercial waste systems. Specifically, the present disclosure includes a commercial waste system including a commercial waste container and a commercial waste vehicle.

Typically, commercial waste containers, known colloquially as dumpsters, are large containers that hold mixed waste. For example, the containers can hold a combination of food waste, recyclables, yard waste, and other waste. Waste containers are often used for waste collection at multi-family dwellings, businesses, restaurants, construction sites, and other locations that generate relatively large amounts of waste over a relatively short time. Traditionally, in order to reduce the amount of waste for final disposal recoverable materials (recyclables) are sorted out of the waste stream prior to garbage pickup. To do so typically requires multiple containers. Accordingly, businesses wishing to separate waste into multiple categories are required to pay for the additional containers, at additional cost to the business. Also, because of their relatively large size, maintaining multiple waste containers for sorting different types of waste is often infeasible, given space constraints at commercial locations.

Additionally, waste collection vehicles are used to collect waste from the containers on a regular schedule. Waste collection vehicles may be of rear load or front load configuration. Traditionally waste collection vehicles, especially in urban environments that afford collection access through alleyways and streets, which allow only limited maneuverability, are rear load configuration. Generally, commercial businesses in urban environments, especially older urban environments are serviced by rear-loading vehicles due to a rear-loading vehicle's ability to more readily operate and maneuver in more restricted areas; in other words areas that have reduced clearance due to building overhangs, fire escapes and overhead utility wires, and multiple building loading and unloading access points. Because of the expense and multiple container requirement involved in sorting waste, waste collection companies typically offer and businesses typically purchase service that collect all waste commingled in one container. Accordingly, collection of multiple (sorted) types of waste (some being described as recoverable or recyclable) typically requires scheduling multiple collections as a separate vehicle is used to collect the recoverable material. This adds further expense as a result of the need to utilize multiple vehicles and multiple conventional collection containers to collect the sorted materials. Because of the additional expense, and inadequate container storage space available to accommodate multiple containers typically associated with waste sorting, many commercial entities forego the process, unnecessarily increasing the amount of waste sent to landfills for final disposal.

Accordingly, there is a need for a waste container divided into multiple compartments to collect waste and/or other multiple types of recoverable (recyclable) materials without comingling and a rear loading truck that includes a divided collection hopper and a divided body with two distinct storage chambers, allowing for collection of the multiple types of waste from the divided container without comingling the collected materials, as described herein.

BRIEF SUMMARY OF THE INVENTION

The present disclosure provides systems and methods for commercial waste containers and vehicles. Various examples of the systems and methods are provided herein.

In an embodiment, the commercial waste container includes a body including a front wall, a rear wall, a bottom surface, and two container side walls, where in the body defines an interior volume. A height of the front wall is less than a height of the rear wall. In addition, the rear wall includes an upper portion and lower portion, wherein the upper portion and the lower portion form an obtuse angle within the rear wall.

The commercial waste container further includes a container divider extending from the front wall to the back wall, wherein the container divider defines within the interior volume of the body a first container chamber and a second container chamber. In addition, the commercial waste container further includes a trunnion bar connected to a top edge of the front wall. The container may further include a slide bar receiver connected to a top edge of a side wall, wherein the slide bar receiver is generally tubular.

In an embodiment, the first container chamber includes a first volume and the second container chamber includes a second volume, wherein the first volume is greater than 50% of the interior volume of the body, wherein the second volume is less than 50% of the interior volume of the body. In yet another example, the container further includes a lid hingedly connected to the rear wall.

The disclosure also provides a commercial waste system including a commercial waste container and a waste collection vehicle. The commercial waste container includes a body including a front wall, a rear wall, a bottom surface, and two container side walls, wherein the body defines an interior volume. In an example, a height of the front wall is less than a height of the rear wall. In another example, the rear wall may include an upper portion and lower portion, wherein an angle between an inner surface of the upper portion and an inner surface of the lower portion is obtuse. Further, the container may include a lid hingedly connected to the rear wall.

The commercial waste container further includes a container divider extending from the front wall to the back wall, wherein the container divider defines within the interior volume of the body a first container chamber and a second container chamber. In an example, the container divider is substantially parallel to the two container side walls. The commercial waste container also includes a trunnion bar connected to a top edge of the front wall.

The waste collection vehicle includes a hopper including two hopper side walls, a first hopper chamber, and a second hopper chamber, wherein the first hopper chamber and second hopper chamber are separated by a hopper divider. The hopper divider is positioned between the two hopper side walls, wherein the hopper divider is parallel to the hopper side walls. Further, each hopper side wall includes at least one opening to receive the trunnion bar.

The vehicle includes a storage container connected to the hopper, wherein the storage container includes a first storage chamber and a second storage chamber, wherein the first storage chamber and second storage chamber are separated by a storage divider. The vehicle further includes a mechanical lift connected to a back end of the vehicle, wherein the mechanical lift includes two side bars and a lift bar. The side bars include a first end and a second end, wherein the first ends are pivotally connected to the vehicle, wherein the second ends are connected to the lift bar. The hopper divider and storage divider are aligned within a first plane. When the commercial waste container is connected to the vehicle, the container divider and hopper divider are aligned in a first plane. When the trunnion bar is inserted into the openings in the hopper side wall, the container divider and hopper divider are aligned in the same plane.

In an example, the system further includes a slide bar and a slide bar receiver, wherein the slide bar receiver is connected to a top edge of a side wall, wherein a slide bar extends through the openings in the hopper side walls and the slide bar receiver.

In yet another example, the first container chamber may include a first volume and the second container chamber includes a second volume. The first volume may be greater than 50% of the interior volume of the body, wherein the second volume may be less than 50% of the interior volume of the body.

The disclosure also provides a method of emptying a commercial waste container including providing a commercial waste container, wherein the commercial waste container includes a body including a front wall, a rear wall, a bottom surface, two container side walls, and a trunnion bar connected to a top edge of the front wall. The container also includes a container divider extending from the front wall to the back wall, wherein the container divider defines a first container chamber and a second container chamber within the interior volume of the body. The commercial waste container may include a container divider substantially parallel to the two container side walls. In an example, a height of the front wall is less than a height of the rear wall. Further, the rear wall may include an upper portion and lower portion, wherein an angle between an inner surface of the upper portion and an inner surface of the lower portion is obtuse.

The method further includes providing a waste collection vehicle including a hopper including a hopper divider, wherein the hopper divider separates a hopper interior space into a first hopper chamber and a second hopper chamber. The hopper includes two hopper side walls, wherein each hopper side wall includes at least one opening to receive a trunnion bar. The vehicle further includes a storage container connected to the hopper, wherein the storage container includes a storage divider. The storage divider separates a storage interior space into a first storage chamber and a second storage chamber. The vehicle also includes a mechanical lift connected to a back end of the vehicle, wherein the mechanical lift includes two side bars and a lift bar. The side bars include a first end and a second end, wherein the first ends are pivotally connected to the vehicle, wherein the second ends are connected to the lift bar. The hopper divider and storage divider are aligned within a first plane.

The method also includes inserting the trunnion bar through the openings in the hopper side walls, such that the lift bar contacts the body of the commercial waste container. In addition, the method includes raising the lift bar of the lifting mechanism such that the lift bar pivots about a connection to the vehicle, wherein the lift bar slides along an outer surface of the body such that the commercial waste container pivots about the trunnion bar. Upon raising the lift bar, the commercial waste container is inverted such that content of the first container chamber is emptied into the first hopper chamber and content of the second container chamber is emptied into the second hopper chamber.

The first container chamber may include a first volume and the second container chamber may include a second volume. The first volume may be greater than 50% of the interior volume of the body, wherein the second volume may be less than 50% of the interior volume of the body.

The disclosure also provides a system including a commercial waste container including a body including a front wall, a rear wall, a bottom surface, and two container side walls, wherein the body defines an interior volume, and a slide bar receiver connected to a top edge of the side wall. The system also includes a waste collection vehicle comprising a hopper including two hopper side walls, a first hopper chamber, and a second hopper chamber, wherein the first hopper chamber and second hopper chamber are separated by a hopper divider, wherein the hopper divider is positioned between the two hopper side walls, wherein the hopper divider is parallel to the hopper side walls, wherein each hopper side wall includes at least one opening to receive a slide bar.

The vehicle also includes a storage container connected to the hopper, wherein the storage container includes a first storage chamber and a second storage chamber, wherein the first storage chamber and second storage chamber are separated by a storage divider. The vehicle further includes a mechanical lift connected to a back end of the vehicle, wherein the mechanical lift includes two side bars and a lift bar, wherein the side bars include a first end and a second end, wherein the first ends are pivotally connected to the vehicle, wherein the second ends are connected to the lift bar. The hopper divider and storage divider are aligned within the same plane. The system also includes a slide bar inserted through the slide bar receiver and the openings within the hopper side wall.

The disclosure also includes a method of emptying a commercial waste container including providing a commercial waste container and providing a waste collection vehicle, both as disclosed herein. The commercial waste container may include a body and a slide bar receiver connected to a top edge of the side wall, wherein the slide bar receiver is tubular.

The method includes inserting a slide bar through the openings in the hopper side walls and the slide bar receiver of the commercial waste container, such that the lift bar contacts the body of the commercial waste container. The method includes raising the lift bar of the lifting mechanism such that the lift bar pivots about a connection to the vehicle, wherein the lift bar slides along an outer surface of the body such that the commercial waste container pivots about the slide bar. Upon raising the lift bar, the commercial waste container is inverted such that the contents of the commercial waste container is emptied into the first hopper chamber, the second hopper chamber, or both.

An advantage of the present systems and methods is providing a manner of collecting both recyclables and non-recyclable waste simultaneously, while keeping the recyclables separate from the non-recyclables.

A further advantage of the present systems and methods is that the system may work with conventional waste containers and commercial waste containers that include a divider to separate recyclables and non-recyclables.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
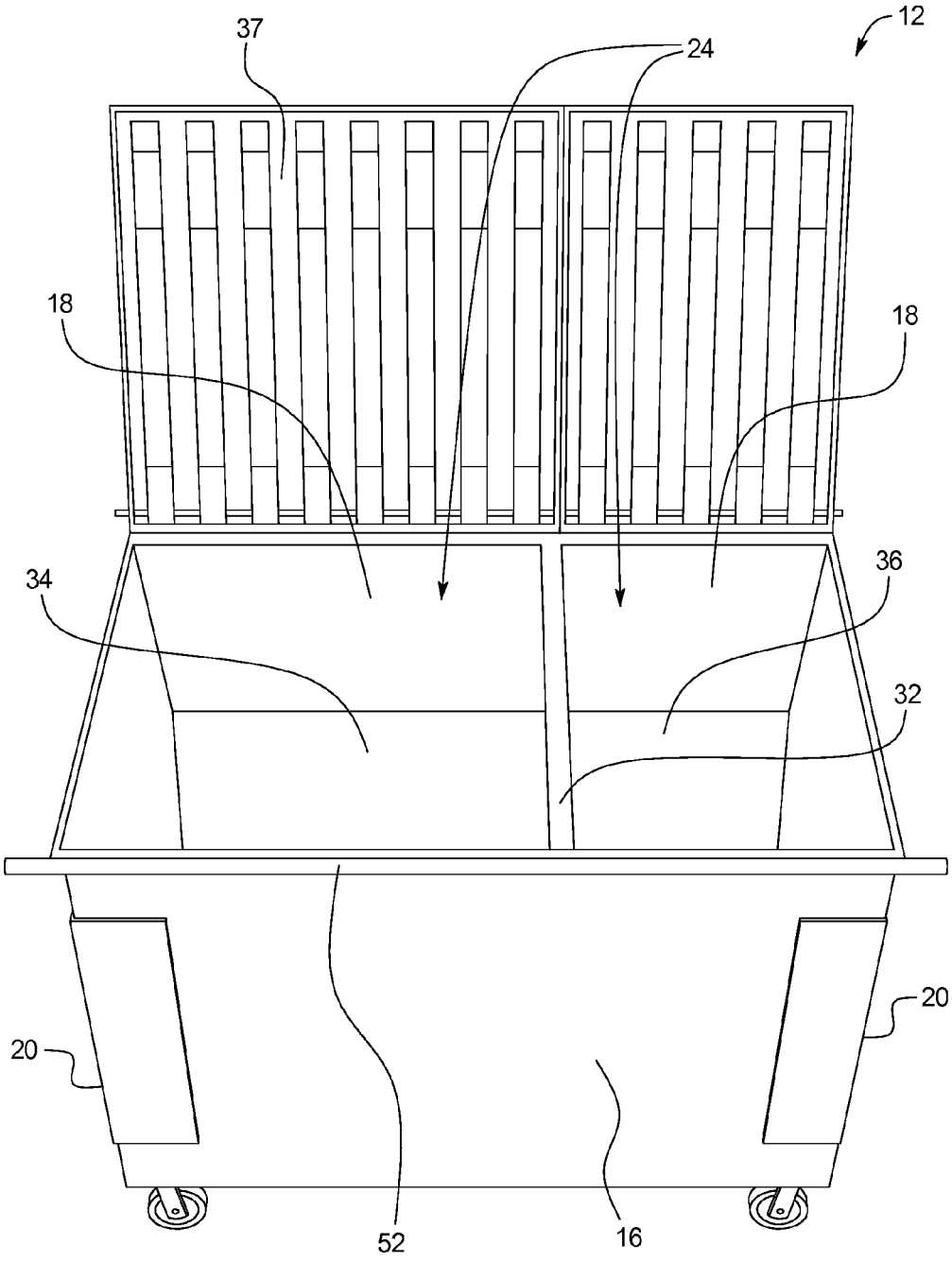
FIG. 1 is a top perspective view of an embodiment of a commercial waste container disclosed herein.
Figure 2B:
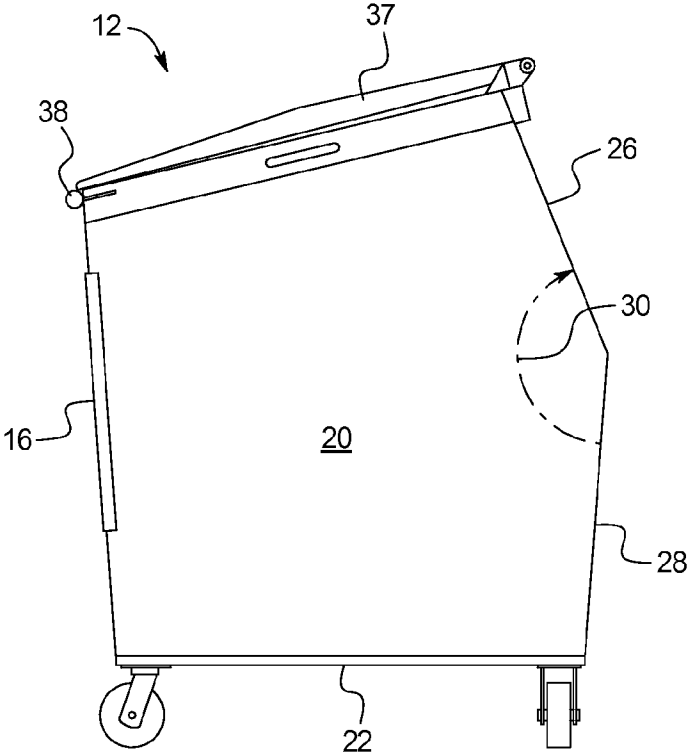
FIG. 2B is a side view of an embodiment of a commercial waste container disclosed herein.
Figure 2A:
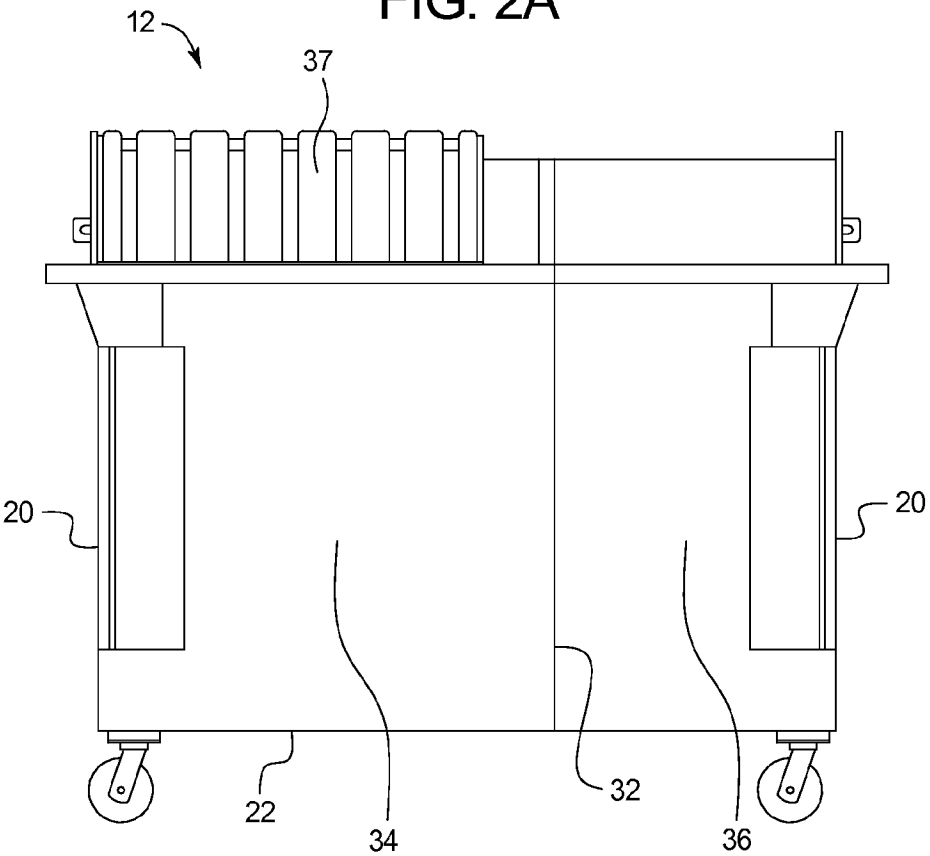
FIG. 2A is a cross-sectional front view of an embodiment of a commercial waste container disclosed herein.

To meet the needs described above and others, the present disclosure provides a commercial waste system 10 including a waste container 12 and a waste vehicle 14. As shown in FIGS. 1 and 2A, the waste container 12 includes an interior volume 24 that may be divided by a container divider 32 into at least two container chambers, for example a first container chamber 34 and a second container chamber 36, to collect waste and/or other multiple types of recoverable (recyclable) materials without comingling. Additionally, the rear loading waste vehicle 14 (FIG. 3) includes a hopper divider 44 and a storage divider 56 such that collection of the multiple types of waste from the divided container does not comingle the collected materials.

The waste container 12 includes a body including a front wall 16, a rear wall 18, a bottom surface 22, and two container side walls 20. As shown in FIG. 2B, the rear wall 18 may include an upper portion 26 and lower portion 28, wherein the upper portion 26 and the lower portion 28 form an obtuse angle 30 within the rear wall 18. In other words, an angle between an inner surface of the upper portion 26 and an inner surface of the lower portion 28 is obtuse. The inclusion of the obtuse angle 30 increases the interior volume 24, and thus the storage capacity, of the waste container 12, as compared to when a rear wall 18 is within one plane.

Additionally, the rear wall 18 may be taller than the front wall 16. The top edges of the front wall 16, rear wall 18, and side walls 20 define a container opening that is angled relative to the base such that the front is lower than the rear. The angled container opening provides an increase in container capacity while maintaining a standard loading height front edge of the container 12. Additionally, the rear wall 18 helps to direct waste into and out of the container 12 during loading and unloading. Some embodiments of the waste container 12 include a relatively taller, sectioned rear wall 18, which allows the container's 12 width and length dimensions to remain similar to those of industry's conventional waste container 12. In some embodiments, the container 12 design also maintains a standard loading height while increasing the overall interior volume 24 of the waste container 12. Maintaining standard dimensions, including width, length, and loading height, may be critical in service areas where space to store a single waste container 12, let alone multiple waste containers 12, is minimal.

The bottom surface 22 is generally rectangular when viewed from above. Casters or other wheels may be attached to the bottom surface 22 near corners to allow for relatively easy movement of the container 12. The bottom surface 22 is formed from a durable material, such as steel, but other materials with similar properties (i.e., stable, weather-resistant, strong, etc.) are contemplated.

The waste container 12 is typically made of steel or other durable materials. The interior volume 24 of the waste container 12 is preferably about three cubic yards, but may be larger or smaller without departing from the scope of the invention. The container 12 is preferably dimensioned such that the overall width is approximately equal to the width of an industry standard waste container 12.

The waste container 12 may also include one or more container divider 32 disposed between the front wall 16 and rear wall 18 or between the two side walls 20. Preferably the container divider 32 is arranged to be substantially parallel with the side walls 20. As shown in FIG. 1, the container divider 32 is used to divide the container into a first container chamber 34 and a second container chamber 36. The container divider 32 is in contact with the front wall 16, the rear wall 18, and the bottom surface 22 such that the waste container 12 is divided into two container chambers. The container divider 32 allows the container 12 to retain material (e.g., waste and /or (recoverable) recyclables) in two separate compartments without the materials intermingling.

For example, the first container chamber 34 may be used to retain non-recyclable waste, while the second container chamber 36 may retain recyclables. While the waste container 12 shown in FIG. 1 is divided so that the first container chamber 34 has a volume that is approximately double the volume of the second container chamber 36, it is contemplated that other ratios could be used. In particular, when the waste container 12 is divided into two container chambers, the volume of the first container chamber 34 is preferably greater than 50% of the interior volume 24, and more preferably in a range of about 60% to about 70% of the interior volume 24.

Additionally, as shown in FIGS. 2A-2B, the waste container 12 may include a lid 37 that covers the container opening. The lid 37 is, for example, hingedly connected to the waste container 12 so that it can be easily opened without being separated from the waste container 12 or misplaced. When the lid 37 is connected to the rear wall 18 of the waste container 12 with a hinge, the lid 37 will open relative to the waste container 12 to allow for unloading when the waste container 12 is tipped forward. The lid 37 can be a single color divided piece, covering the entire opening, or two separate colored lids 37, separated such that each of the container chambers has a separate lid 37. The lid(s) 37 help to contain odors, protect the waste and/or recoverables (recyclables) from the elements, and help prevent animals from entering the waste container 12. Additionally, color of the lid 37 serves as a visual indicator to users, which helps delineate what materials go in each container chamber. The waste container 12 preferably also includes features such as handles disposed on the side walls 20 to allow waste collectors and other users to roll the waste container 12 relatively easily.

Figure 6B:
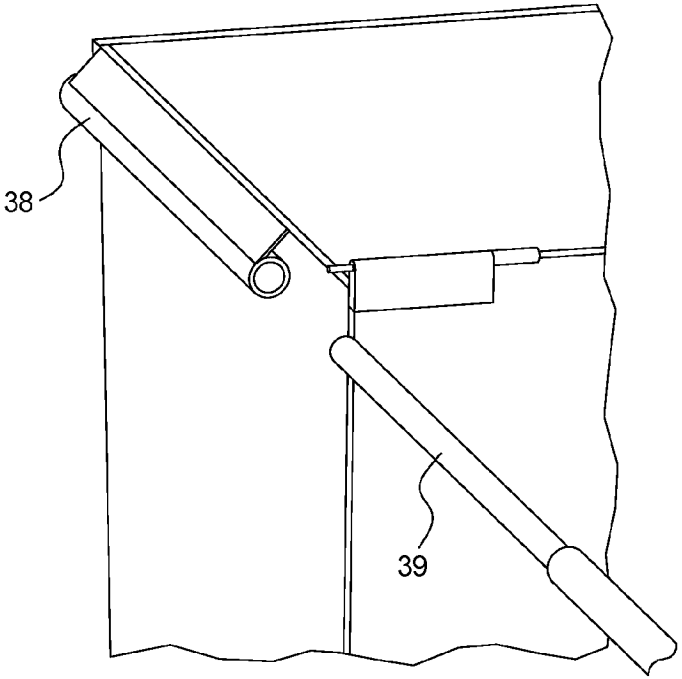
FIGS. 6A-6C are perspective views of the commercial waste container, depicting trunnion bar receivers.
Figure 6A:
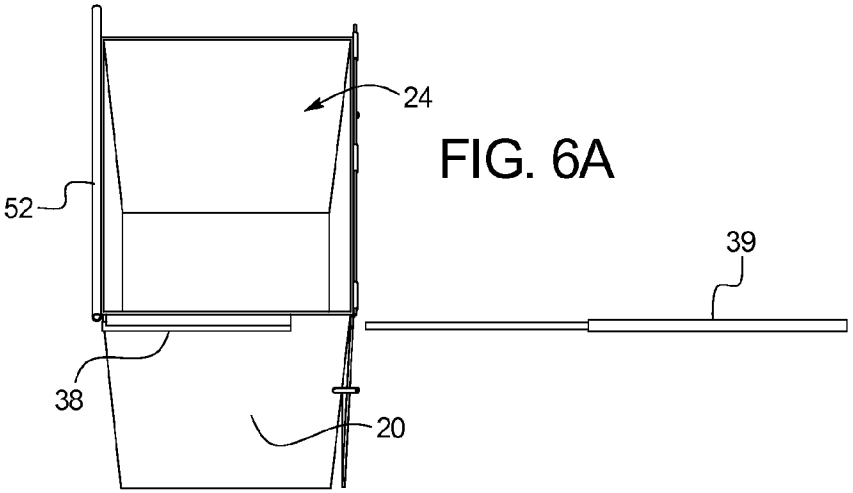
Figure 6C:
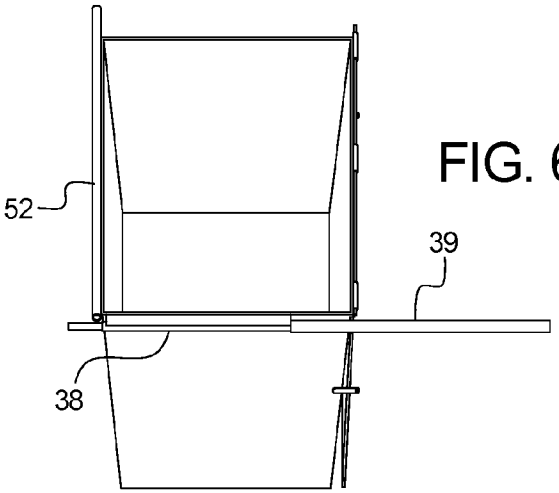

The waste container 12 may include a trunnion bar 52 attached along a top edge of the front wall 16, as shown in FIG. 1. For example, the trunnion bar 52 may be permanently welded to the top edge of the front wall 16. Alternatively, or in addition to, as shown in FIG. 6B, the waste container 12 may also include a slide bar receiver 38, wherein the slide bar receiver 38 is generally tubular to receive a slide bar 39. For example, as shown in FIGS. 6A-6C, the waste container 12 may include a trunnion bar 52 connected to a top edge of the front wall 16 and a slide bar receiver 38 connected to a top edge of at least one container side wall 20. As shown in FIGS. 6A-6C, a slide bar 39 may be inserted into the slide bar receiver 38.

In an example, the trunnion bar 52 extends horizontally, widthwise relative to the container beyond each side wall 20 or the front wall 16 on either side of the waste container 12. The trunnion bar 52 is used to connect the waste container 12 to the waste vehicle 14 and to hold the waste container 12 substantially in place on the hopper 42 of waste vehicle 14 during waste collection.

Figure 4A:
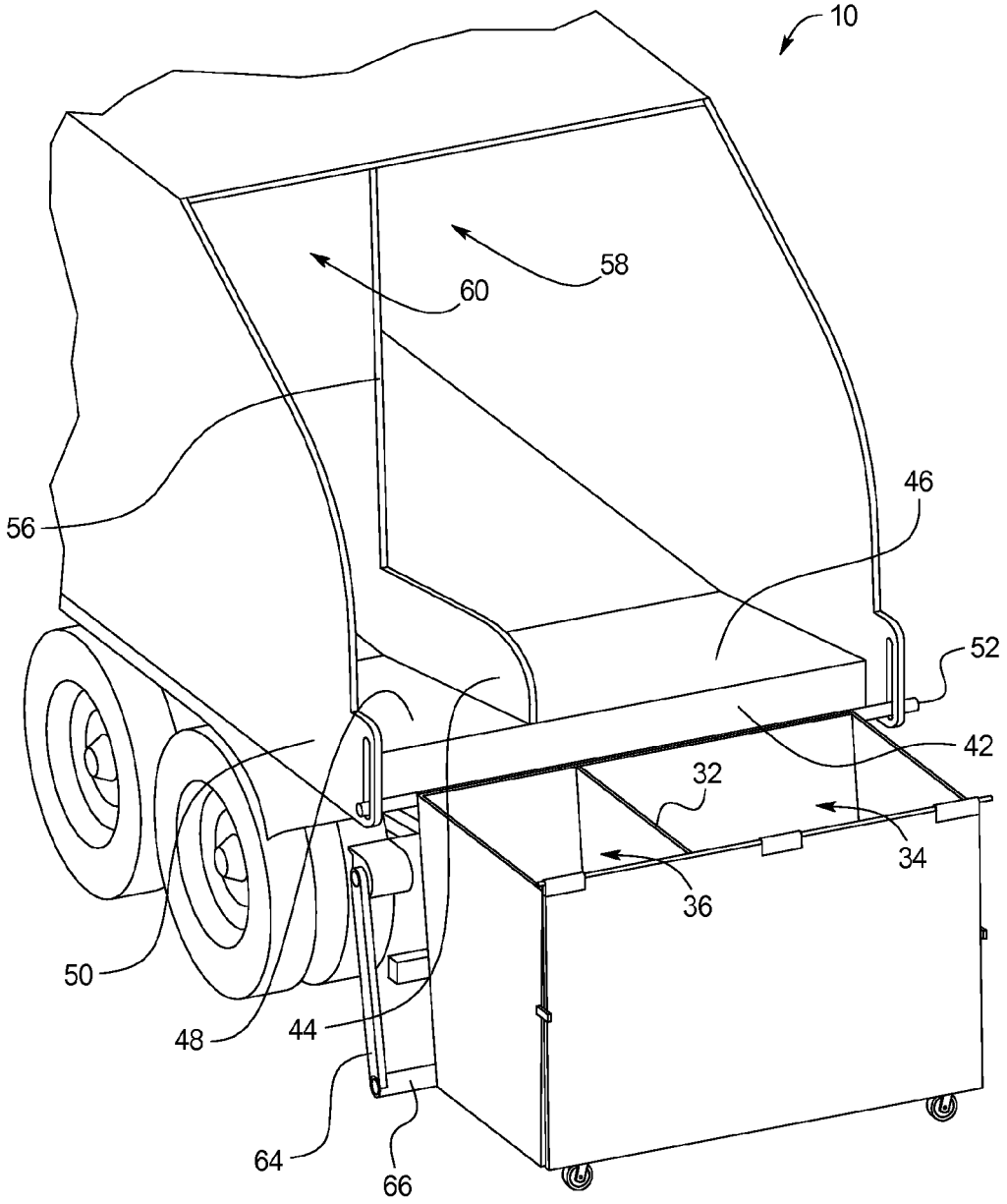
FIGS. 4A-4B are perspective views of the system disclosed herein, wherein the commercial waste container is emptied into the waste vehicle.
Figure 7A:
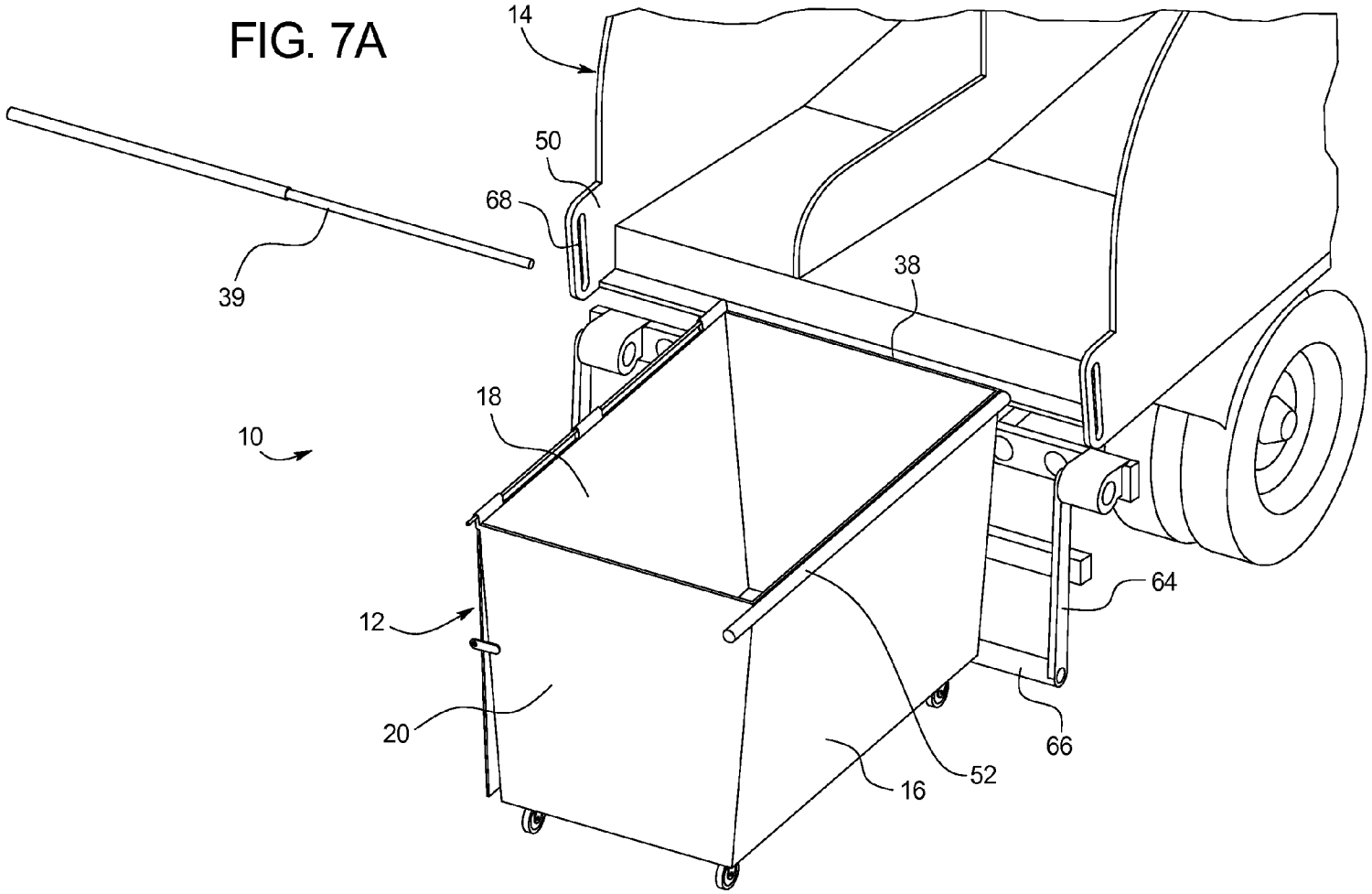
FIGS. 7A-7B are perspective views of the system, depicting the insertion of the trunnion bar through openings in the side wall of the hopper and the trunnion bar receiver of the commercial waste container.
Figure 7B:
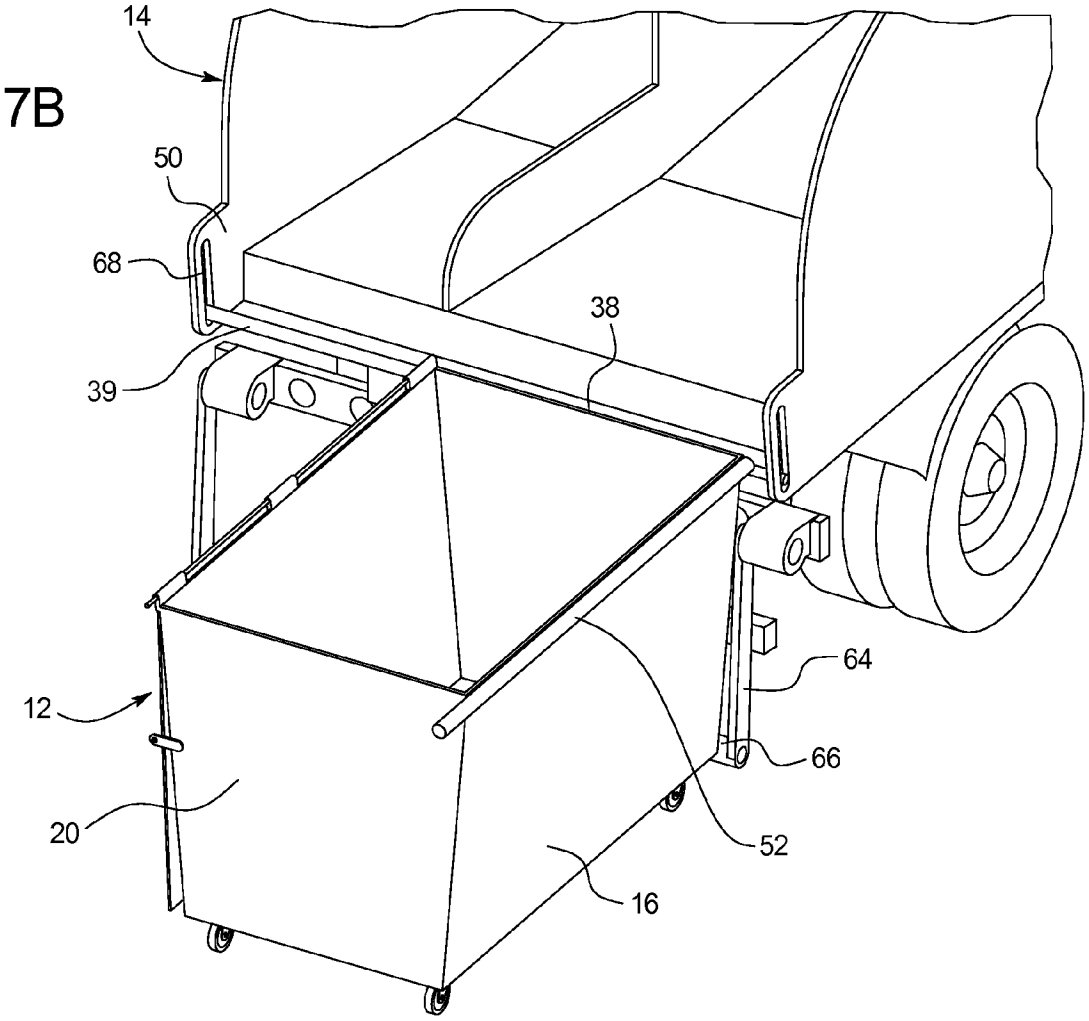

For example for use with containers 12 containing a divider 32, as shown in FIG. 4A, the trunnion bar 52 is inserted into the openings 68 in the hopper side wall 50, such that the interior volume 24 of the waste container 12 is emptied into both the first hopper chamber 46 and the second hopper chamber 48. Alternatively, for use with non-divided containers 12, as shown in FIGS. 7A-7B, a slide bar 39 is inserted into the slide bar receiver 38, such that the entire interior volume 24 of the waste container 12 may be emptied into either of the chambers, for example, the first hopper chamber 46.

Figure 3:
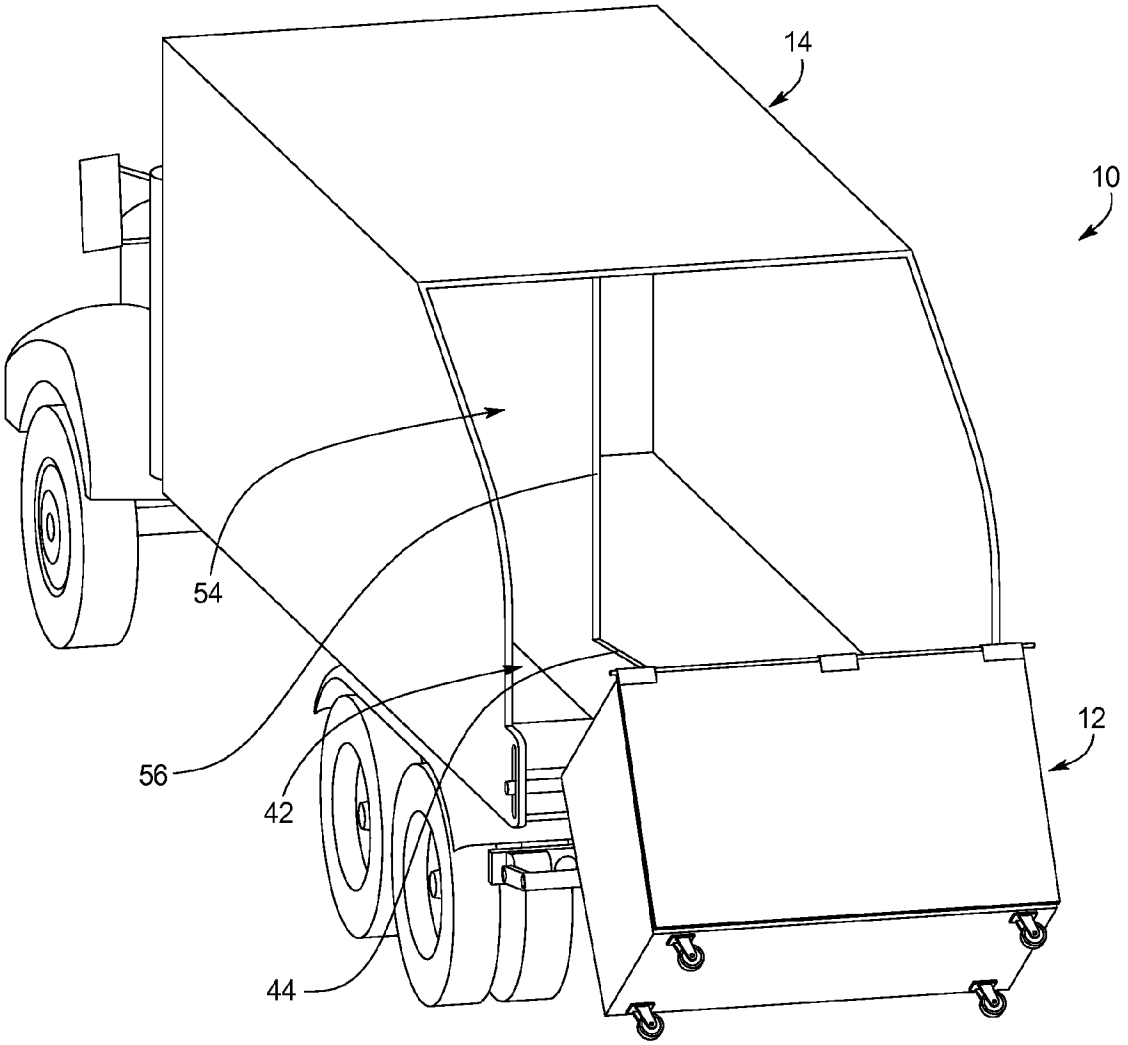
FIG. 3 is a perspective view of an embodiment of the system disclosed here, wherein a commercial waste container is engaged with a waste vehicle.
Figure 4B:
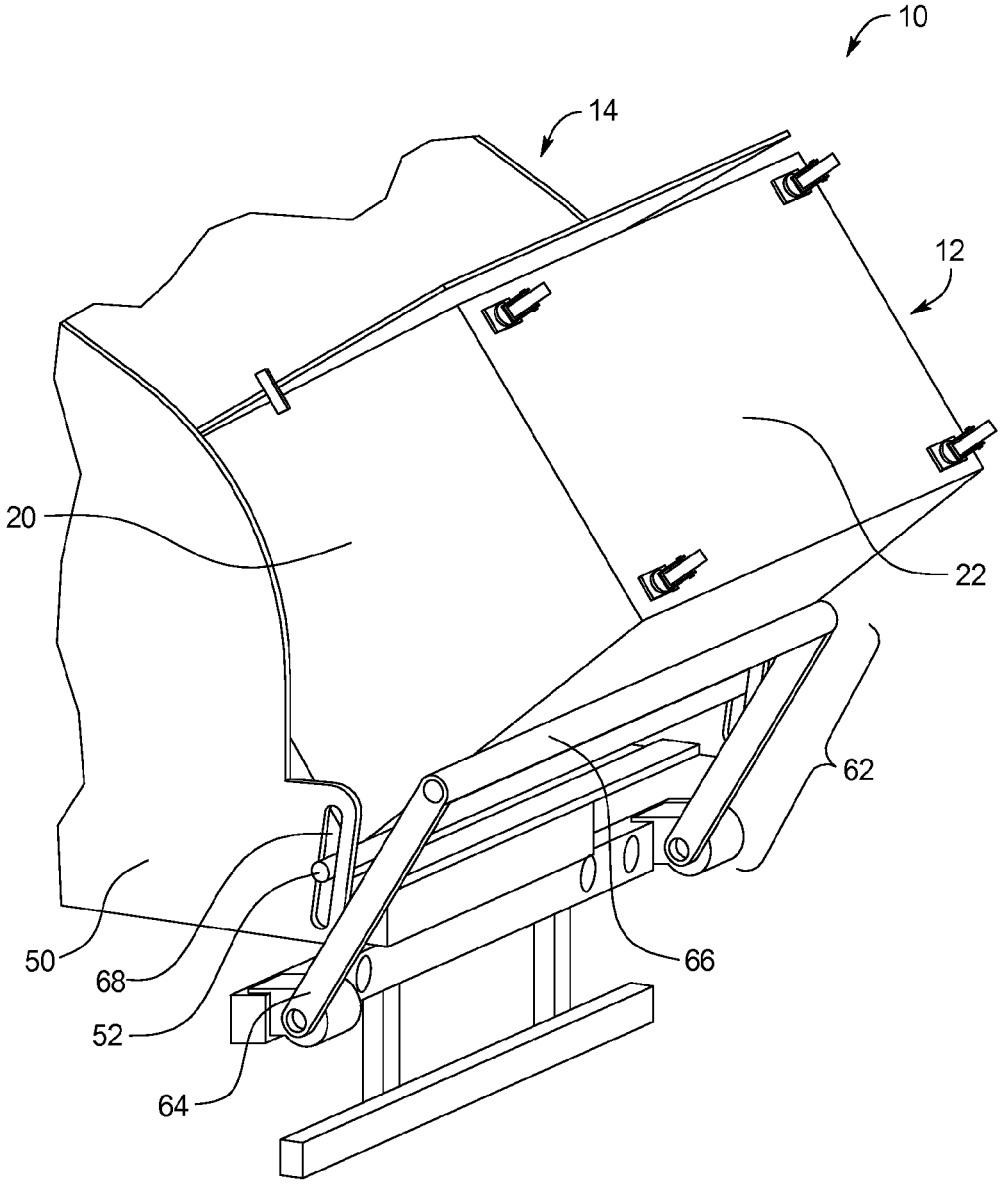
Figure 5:
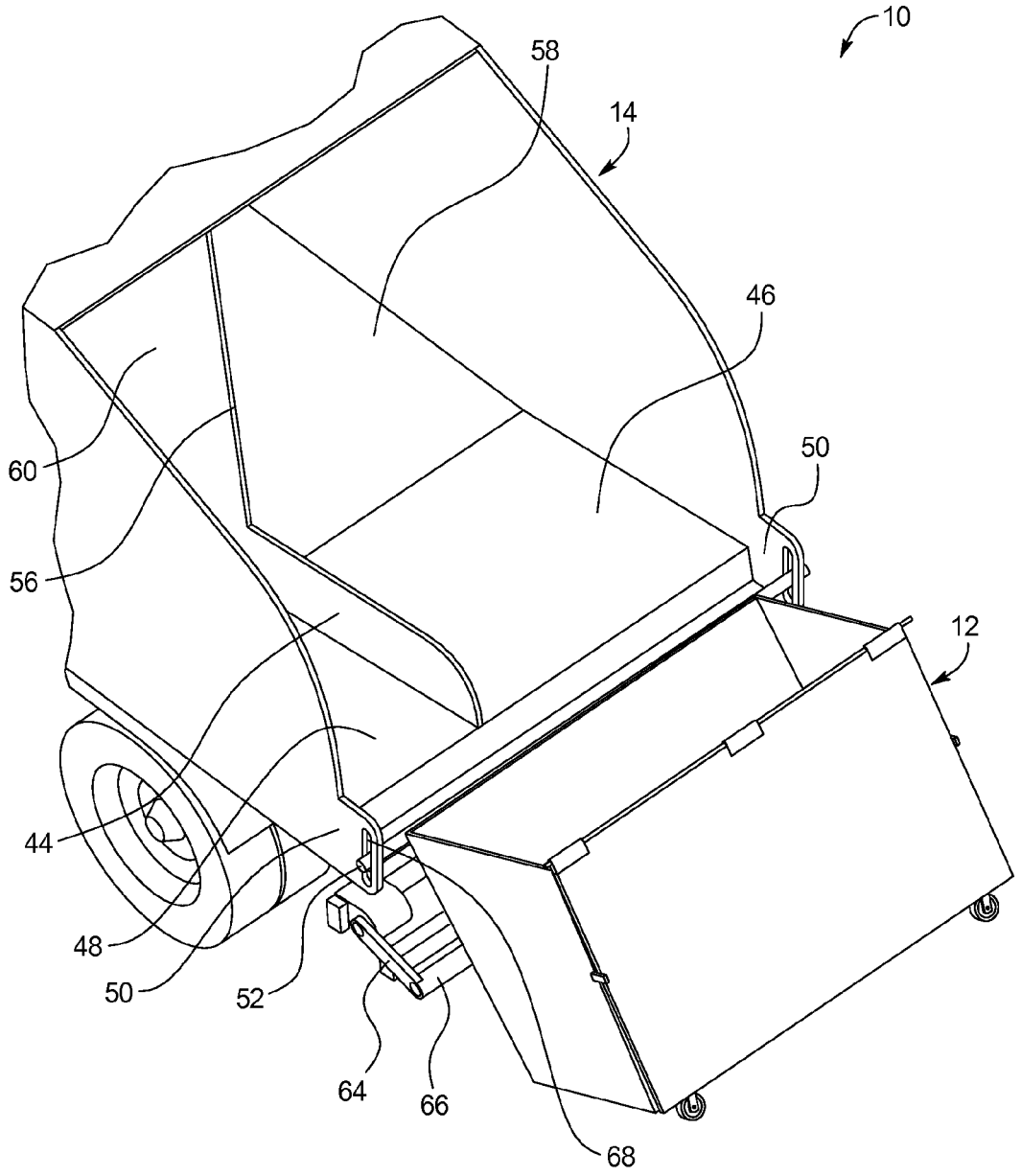
FIG. 5 is a perspective view of the system disclosed herein, wherein the waste container does not include a container divider.

As shown in FIG. 3, the waste containers 12 are designed for use with rear-loading waste collection vehicles 14. The waste vehicle 14 preferably has a relatively large divided storage container 54 with a rear opening for loading materials (waste and/or recoverables (recyclables)) into the hopper 42. Additionally, as shown in FIGS. 4A-4B, the vehicle 14 includes a mechanical lift 62 to empty the contents (waste-recyclables) from waste containers 12 without the operator having to lift the container 12 by hand. The mechanical lift 62 allows lifting of relatively large and heavy containers 12, which are a practical necessity for commercial businesses. As shown in FIG. 5, the waste vehicle 14 may be used with conventional waste containers 12 that do not include a container divider 32.

The collection vehicle 14 includes a large storage container 54 used to hold and store materials from the emptied containers 12. The storage container 54 is preferably divided into distinct storage chambers by a storage divider 56. For example, the storage container 54 may be divided into a first storage chamber 58 and a second storage chamber 60. Further, when the waste container 12 is attached to the waste vehicle 14, the container divider 32 and storage divider 56 are within the same vertical plane.

The vehicle 14 further includes a hopper 42 at the rear opening of the vehicle 14. The hopper 42 includes a hopper divider 44 that may separate the hopper 42 into a first hopper chamber 46 and a second hopper chamber 48. The hopper divider 44 may be tapered (or include a cutaway portion) to allow containers 12 to rotate into position for emptying, while still maintaining a division between the first hopper chamber 46 and the second hopper chamber 48. The lateral position of the hopper divider 44 is preferably aligned within a first plane, wherein the storage divider 56 is contained within the first plane. Similarly, the hopper divider 44 is preferably substantially aligned within the same plane as the container divider 32 when the container 12 is being emptied into the waste vehicle 14.

The vehicle 14 may further include a locking mechanism used to retain and release the waste container 12 during the emptying process. The locking mechanism may include the slide bar receiver 38 of the waste containers 12, openings 68 within the hopper side walls 50, and the slide bar 39. The locking mechanism may include the trunnion bar 52 and the openings 68 within the hopper side walls 50. For example, as shown in FIGS. 7A-7B, the slide bar 39 may be inserted through openings 68 in the hopper side walls 50 and the slide bar receiver 38 to secure the waste container 12 to the waste vehicle 14. Alternatively, the trunnion bar 52 may engage with the openings 68 of the hopper side walls 50 to secure the waste container 12 to the waste vehicle 14. Once the waste container 12 is connected to the vehicle 14 via the locking mechanism, the mechanical lift 62 may be used to rotate and partially invert the container 12.

Figure 8B:
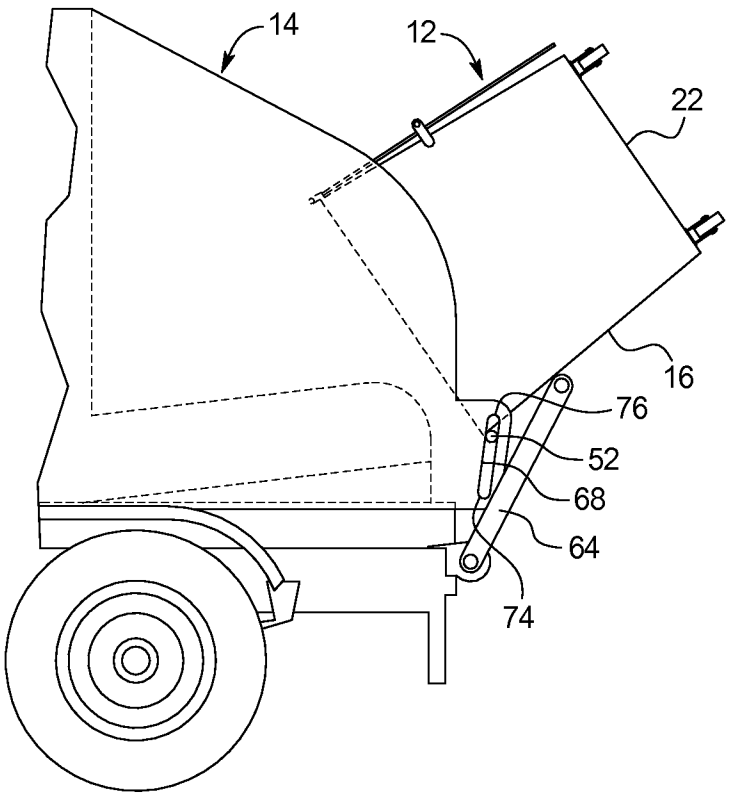
FIGS. 8A-8B are side views of the system, depicting the lift mechanism of the system.
Figure 8A:
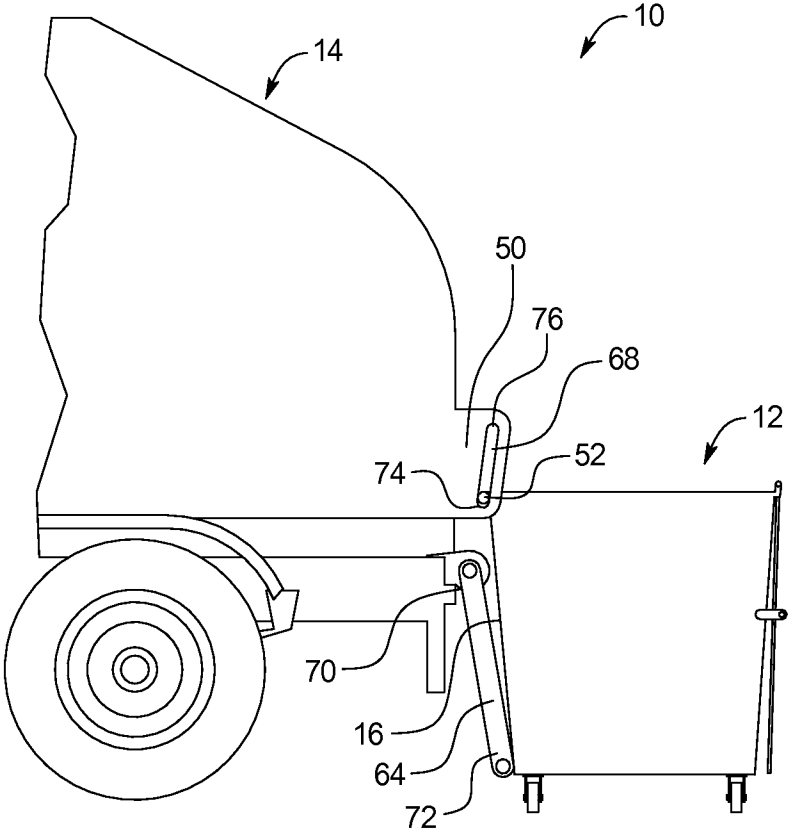

The mechanical lift 62 includes a lift bar 66 that applies force near the bottom of the front wall 16 or side wall 20 of the waste container 12 that has been locked to the vehicle 14. The mechanical lift 62 further includes two side bars 64, wherein a first end 70 of the side bars 64 are attached to the vehicle 14 and the second ends 72 of the side bars 64 are connected to the lift bar 66. The side bars 64 may be attached to any part of the vehicle 14 near the rear opening. In an example, the side bars 64 may attach to the hopper 42. As shown in FIGS. 8A-8B, the side bars 64 are attached to the vehicle body such that upon raising the lift bar 66, the lift bar 66 pivots about the connection to the vehicle 14. Further, as the lift bar 66 is raised, the lift bar 66 slides along an outer surface of the body of the container 12 as the waste container 12 is raised and at least partially inverted.

The force of the lift bar 66 is applied in an outward and upward direction, causing the waste container 12 to rotate or pivot about the axis defined by the trunnion bar 52 or slide bar 39, depending on which locking mechanism is used. Force is preferably applied using hydraulic or pneumatic pumps. However, other means of applying force are contemplated. The waste container 12 rotates about the axis defined by the trunnion bar 52 or the slide bar 39 until the side walls 20 or front wall 16 makes contact with stops affixed to the vehicle 14. The stops are specifically positioned to prevent the waste container 12 from rotating so far that the waste container 12 no longer returns to its upright position using only the force of gravity.

As shown in FIGS. 8A-8B, as the lift bar 64 raises and rotates the waste container 12 about the trunnion bar 52, the trunnion bar 52 may slide from an opening first end 74 in the hopper side wall 50 to an opening second end 76. Although the figures depict both the opening first end 74 and opening second end 76 are closed, it is contemplated that at least the first opening 74 or the opening second end 76 may be open ended. When the waste container 12 is connected to the waste vehicle 14 in an upright position, the trunnion bar 52 is positioned near the opening first end 74 of the opening 68 of the hopper side wall 50, as shown in FIG. 8A. As the waste container 12 moves into an inverted position, the trunnion bar 52 moves towards the opening second end 76 of the opening 68, as shown in FIG. 8B. Analogous movement of the slide bar 39 is achieved when the waste container 12 is connected to the waste vehicle 14 by way of the slide bar 39, wherein the waste container 12 rotates about the slide bar 39 during the lifting and emptying of the waste container 12 into the waste vehicle 14.

As the waste container 12 is rotated upward, the waste and/or recoverables (recyclables) fall from the container 12 into the vehicle 14. When the waste container 12 includes a container divider 32 and the container divider 32 is aligned with the hopper divider 44, the materials from each of the container chambers remain separated, and the two types of material collected are not intermingled. Once the waste and/or recoverables-recyclables have been emptied from the waste container 12, the lift bar 66 of the mechanical lift 62 returns to its normal position, which allows the waste container 12 to rotate back to an upright position. Once the waste container 12 has returned to its normal orientation, the trunnion bar 52 or slide bar 39 may be removed from the openings 68, and the waste collection vehicle 14 can continue on its route.

The waste vehicle 14 preferably also includes a compacting apparatus used to compact the collected waste and/or recoverables (recyclables). The compacting apparatus may include a single compactor that compacts materials collected in both storage chambers, or separate compactors for each the first storage chamber 58 and the second storage chamber 60. The compactor moves waste and/or recoverables (recyclables) from the hopper 42 into the storage chambers and compacts the materials in the storage chambers.

It should be noted that various changes and modifications to the embodiments described herein will be apparent to those skilled in the art. Such changes and modifications may be made without departing from the spirit and scope of the present invention and without diminishing its attendant advantages. For example, various embodiments of the method and device may be provided based on various combinations of the features and functions from the subject matter provided herein.

I claim:

1. A commercial waste system comprising:

a commercial waste container including, a body including a front wall, a rear wall, a bottom surface, and two container side walls, wherein the body defines an interior volume, and a slide bar receiver connected to a top edge of the side wall; and a waste collection vehicle comprising, a storage container including a hopper portion, wherein the storage container includes a first storage chamber and a second storage chamber, wherein the first storage chamber and second storage chamber are separated by a storage divider, the hopper portion of the storage container including first and second hopper side walls, a first hopper chamber, and a second hopper chamber, wherein the first and second hopper chambers are separated by the storage divider, wherein the storage divider is positioned between and parallel to the two hopper side walls, wherein each hopper side wall includes at least one opening, and a mechanical lift connected to a back end of the vehicle, wherein the mechanical lift includes two side bars and a lift bar, wherein the side bars include a first end and a second end, wherein the first ends are pivotally connected to the vehicle rearward of two or more rearmost wheels and rearward of the storage container, wherein the second ends are connected to the lift bar rearward of the two or more rear wheels; and a slide bar inserted through the slide bar receiver and the openings within the first and second hopper side walls.

2. The system of claim 1 further comprising a container divider defining a first container chamber and a second container chamber, wherein the first container chamber includes a first volume and the second container chamber includes a second volume, wherein the first volume is greater than 50% of the interior volume of the body, wherein the second volume is less than 50% of the interior volume of the body.

3. The system of claim 2 wherein the container divider is substantially parallel to the two container side walls.

4. The system of claim 1 wherein a height of the front wall is less than a height of the rear wall.

5. The system of claim 1 wherein the rear wall includes an upper portion and lower portion, wherein an angle between an inner surface of the upper portion and an inner surface of the lower portion is obtuse.

6. The system of claim 1 wherein the storage divider includes a hopper divider that separates the first hopper chamber and the second hopper chamber.

7. The system of claim 1 wherein the hopper portion and the storage container form a continuous space.

8. A commercial waste container comprising:

a body including a front wall, a rear wall, a bottom surface, and first and second container side walls, wherein the body defines an interior volume, wherein a height of the front wall is less than a height of the rear wall, wherein the rear wall includes an upper portion and lower portion, wherein an angle between an inner surface of the upper portion and an inner surface of the lower portion is obtuse;

a container divider extending from the front wall to the back wall, wherein the container divider defines within the interior volume of the body a first container chamber and a second container chamber;

a trunnion bar connected at a top edge of the front wall; and a slide bar receiver connected at a top edge of one of the first and second container side walls.

9. The container of claim 8 wherein the slide bar receiver is generally tubular.

10. The system of claim 8 wherein the container further includes a lid connected to the rear wall via a hinge.

* * * * *